US008469290B2

(12) United States Patent
Ciriani

(10) Patent No.: US 8,469,290 B2
(45) Date of Patent: Jun. 25, 2013

(54) INTEGRAL MINIATURISED NEBULISER FOR ELASTICALLY DEFORMABLE BOTTLE

(75) Inventor: Angel Ciriani, Berazategui (AR)

(73) Assignee: Emsar S.p.A., San Giovanni Teatino (IT)

( * ) Notice: Subject to any disclaimer, the term of this patent is extended or adjusted under 35 U.S.C. 154(b) by 1190 days.

(21) Appl. No.: 11/628,367

(22) PCT Filed: Jun. 8, 2005

(86) PCT No.: PCT/IT2005/000322

§ 371 (c)(1),
(2), (4) Date: Dec. 4, 2006

(87) PCT Pub. No.: WO2005/120719

PCT Pub. Date: Dec. 22, 2005

(65) Prior Publication Data

US 2008/0061164 A1 Mar. 13, 2008

(30) Foreign Application Priority Data

Jun. 11, 2004 (IT) ..... RM2004A0289
Apr. 29, 2005 (IT) ..... RM2005A0203

(51) Int. Cl.
*A62C 13/62* (2006.01)

(52) U.S. Cl.
USPC ..... 239/327; 239/424; 239/472; 239/538; 239/579; 239/581.1; 222/321.6; 222/380; 222/562

(58) Field of Classification Search
USPC ..... 239/327, 318, 323, 328, 339, 372, 239/418, 423, 424–425, 426, 437, 443–446, 448, 449, 455, 504–507, 518, 537, 538, 579, 581.1; 222/321.6, 380, 562
See application file for complete search history.

(56) References Cited

U.S. PATENT DOCUMENTS

| | | | |
|---|---|---|---|
| 4,020,979 | A | 5/1977 | Shay et al. |
| 4,157,789 | A | 6/1979 | Laauwe |
| 4,415,122 | A | 11/1983 | Laauwe et al. |

FOREIGN PATENT DOCUMENTS

| | | |
|---|---|---|
| DE | 100 64 630 | 6/2002 |
| FR | 1028776 | 5/1953 |
| FR | 1158938 | 6/1958 |
| JP | 60 051562 | 7/1985 |

*Primary Examiner* — Christopher Kim
(74) *Attorney, Agent, or Firm* — Young & Thompson

(57) ABSTRACT

An integral miniaturized nebulizer for an elastically deformable bottle (1), provided with a rotatable closing cap (5), with discharge orifice, and with a suction tube (16) immersed in the liquid to be nebulized, includes a head (3) in a single piece with a body (4) connectable to an elastically deformable bottle (1). The head (3) internally has an elbow conduit (13) for the liquid to be sprayed, extending in a longitudinal segment (14) able to engage the suction tube (16), and in a transverse segment (15) able to end in the discharge orifice of the rotatable closing cap (5) when the cap (5) is in the nebulization position. The transverse segment (15) is coaxial inside a conduit (18) of the air inside the bottle (1) and in communication therewith via a plurality of radial channels (25) drilled in the terminal end of the same transverse segment (15).

15 Claims, 6 Drawing Sheets

INTEGRAL MINIATURISED NEBULISER FOR ELASTICALLY DEFORMABLE BOTTLE

TECHNICAL FIELD

The present invention relates to a miniaturised nebuliser for elastically deformable bottle.

BACKGROUND ART

Small, convenient to carry devices for nebulising perfume products and liquid cosmetics are already on the market.

In particular, they are nebulisation devices based on bottles whose compression generates and overpressure inside the bottle which causes the creation, through appropriate convergent channels, of a flow of air and a flow of liquid. Said currents are mixed just before the discharge orifice and the mechanical mixing of air and product in turbulent conditions generates the nebulisation. Such devices constitute a low cost alternative to mechanical nebulising micro-pumps.

From U.S. Pat. No. 4,186,882 granted on 5 Feb. 1980 a nebuliser for liquids is already known, which comprises a manually deformable container having a neck and an opening. The opening is provided with an elastic baffle provided holes, sustaining at its centre a nozzle for the distribution of liquid, connected to a suction tube. On the opening is also applied a covering element provided with a central discharge orifice. Between the covering element and the elastic baffle is created a mixing chamber in which are united the liquid coming from the interior of the container through the suction tube, and the air exiting due to the overpressure inside the container through the holes of the elastic diaphragm.

The adjustment of the flow rate and density of the jet is obtained by varying the distance between the covering element and the liquid distribution nozzle thanks to a screw-on coupling between the covering element and the neck of the bottle.

Lastly, on the covering element is applied a screw-on cap which closes the mixing chamber, preventing liquid from escaping outwards. Since the cap is removable, there are various easily intuited drawbacks linked to this fact.

German patent No. 10064630 discloses a nebuliser head provided with an integrated closing device which, rotating around the longitudinal axis, opens and closes the conduit for dispensing the product according to whether the passage holes are aligned or not. The conduit of the liquid flows into the air conduit, positioned transversely at the head of the former, in a rather distant point from the exit hole. This geometry has the advantage of exploiting also the Venturi effect to draw a suction on the liquid from the suction tube, but it requires a good air-liquid ratio and hence a sizeable quantity of air. The result is a questionable effectiveness in miniaturised systems.

U.S. Pat. No. 4,530,466 discloses a very simple nebuliser device, with a reduced number of components. The flow of air takes place through conduits obtained by means of grooves positioned on the periphery of the cylindrical seat of the suction tube. The conduits are obtained from the coupling of the suction tube with the nebuliser nozzle and each of them consists of a longitudinal segment—coaxial to the suction tube—and a radial terminal segment. The air is thus blown along said radial channels, orthogonally to the direction of the liquid, immediately behind the discharge hole. These channels do not have appropriate shape and dimensions to generate a vortex motion for the air, because they are obtained by coupling with the suction tube. For this reason, the dimensions of the channel are influenced by the correct fit of the suction tube and the cut of its end. This circumstance is particularly penalising when a similar air-liquid mixing system is to be adopted on miniaturised products. Moreover, there is a constraint on the direction of the spray, which must necessarily be along the axis of the bottle. While in some applications such a condition is in fact optimal (take the case of deodorants), in others an orthogonal spray to the axis of the bottle is preferred. This is especially true in those sectors (such as perfumes) where use of nebuliser micro-pumps that operate in this way is consolidated.

DISCLOSURE OF INVENTION

The present invention aims to overcome the drawbacks of the prior art.

In particular, an object of the present invention is to provide a nebuliser for elastically deformable bottles which can be easy and intuitive as the ones mentioned above, but also characterised by reduced dimensions, to the extent that it is conveniently "pocket carried", and obtained with the minimum possible number of components.

Another object is to provide an integral nebuliser, i.e. complete with deformable container for the liquid and with rotatable closing device connected to the system in such a way that it is not necessary to remove it during use.

Yet another object is to provide a nebuliser in which the mixing of air and liquid is accomplished in quite precise fashion so the spray is effective even with containers having very small capacity and complete emptying is possible without compromising performance.

An additional object of the invention is to provide a nebuliser in which the direction of the spray is orthogonal to the axis of the bottle, similarly to widely used applications in the perfume and cosmetics industry. Yet another object of the invention is to provide a nebuliser whose shape is such as to make easy and intuitive, in addition to ergonomic, both the operation and the opening and closing of the system, and which assures, in addition to an aesthetic consistency between the parts, also a correct coupling of the surfaces that provide the mixing and outflow conduits.

A further object of the invention is to allow an easy loading of the liquid to be nebulised in the bottle.

The above objects are achieved by an integral miniaturised nebuliser for elastically deformable bottle, provided with a rotatable closing cap with discharge orifice, and with a suction tube immersed in the liquid to be nebulised, which, from a general viewpoint, is characterised in that the nebuliser comprises a head in a single piece with a body connectable to an elastically deformable bottle, the head having internally an elbow conduit for the liquid to be sprayed extending, in a longitudinal segment able to engage the suction tube, and transversely thereto, in a transverse segment able to end in the discharge orifice of the rotatable closing cap when said cap is in the nebulisation position, said transverse segment of the elbow conduit of the liquid being coaxially internal to a conduit of the air inside the bottle and in communication therewith by means of a plurality of radial channels drilled in the terminal end of the same transverse segment of the elbow conduit for the liquid.

The invention shall become more readily apparent from the detailed description that follows of two embodiments thereof, considered together with the accompanying drawing, in which:

DESCRIPTION OF THE DRAWINGS

FIG. 5 is an enlarged detail of the nebuliser of FIG. 4;

DESCRIPTION OF THE ILLUSTRATIVE EMBODIMENTS

Figure 1:
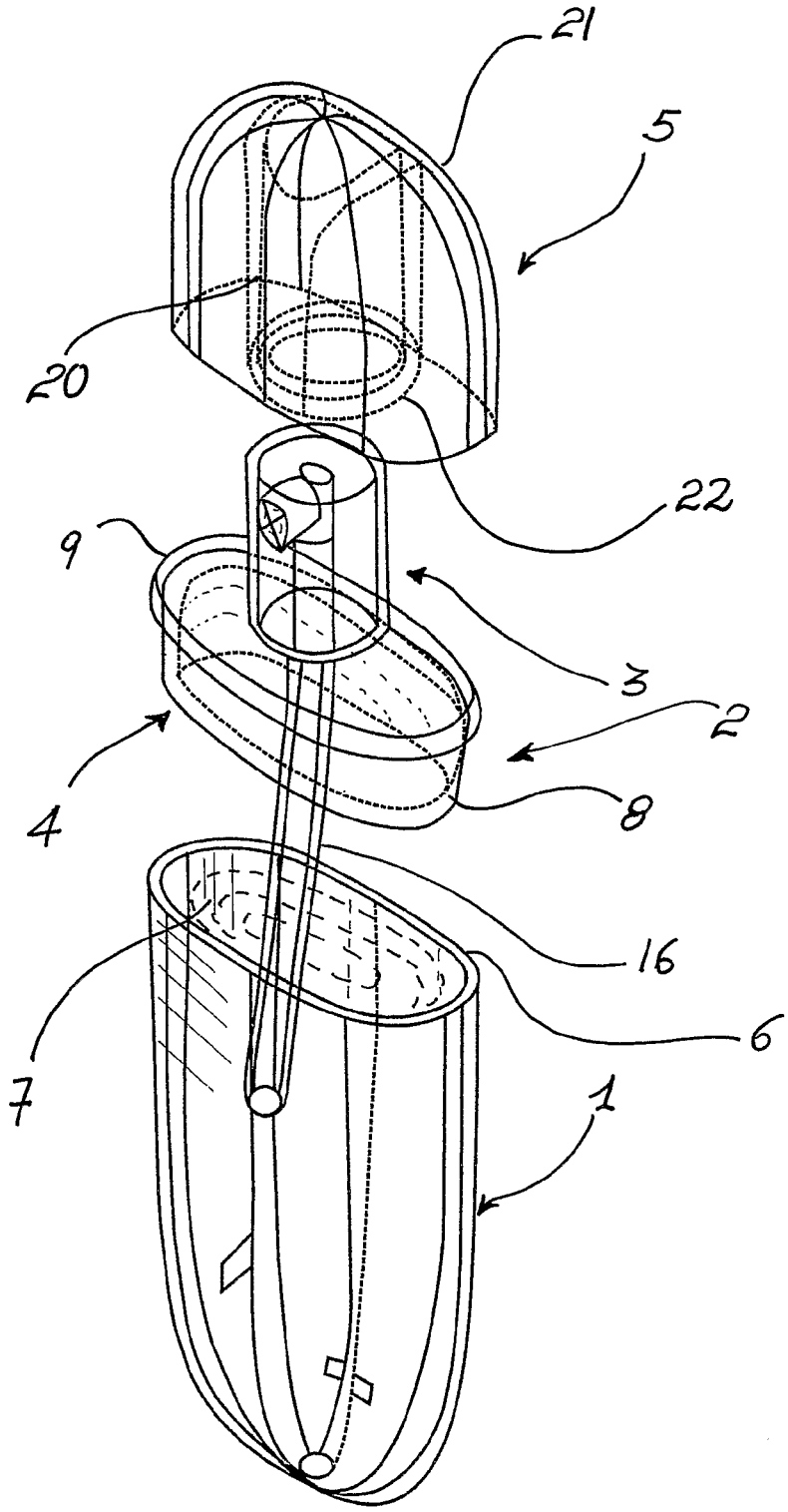
FIG. 1 is a perspective exploded, transparent, of an elastically deformable bottle provided with a nebuliser and with a closing cap according to a first embodiment of the present invention.

With reference initially to FIG. 1, it is an exploded, perspective view of the integrated nebuliser according to the first embodiment of the present invention, transparent to highlight internal parts. The reference number 1 globally designates an elastically deformable bottle, 2 designates a nebuliser, constituted by a head 3 and a body 4, and 5 is a rotatable closing cap. All parts are made of a suitable plastic material.

The bottle 1 has substantially ellipsoidal shape, cut transversely to the longitudinal axis to terminate in an elliptic end 6. naturally, the shape could also be different. Internally, in the vicinity of the cut part, are provided peripheral grooves 7. Said grooves 7 engage corresponding projections 8 provided in the body 4 of the nebuliser 2. The grooves 7 and the projections 8 in mutual engagement constituted detachable connection means between the bottle 1 and the nebuliser 2.

The body 4 of the nebuliser 2 has an ellipsoidal external profile, intended for insertion into the bottle. The projections 8 are formed peripherally in the profile. The body 4 ends with an edge 9 projecting from the outer profile. The edge 9 serves as an abutment of the body 4 of the nebuliser 2 on the elliptical end 6 of the bottle 1.

The head 3 of the nebuliser 2 is in a single piece with the body 4. The head 3 is substantially cylindrical, for construction reasons slightly cone frustum shaped, with a summit 10 and a lateral surface 11.

Figure 2:
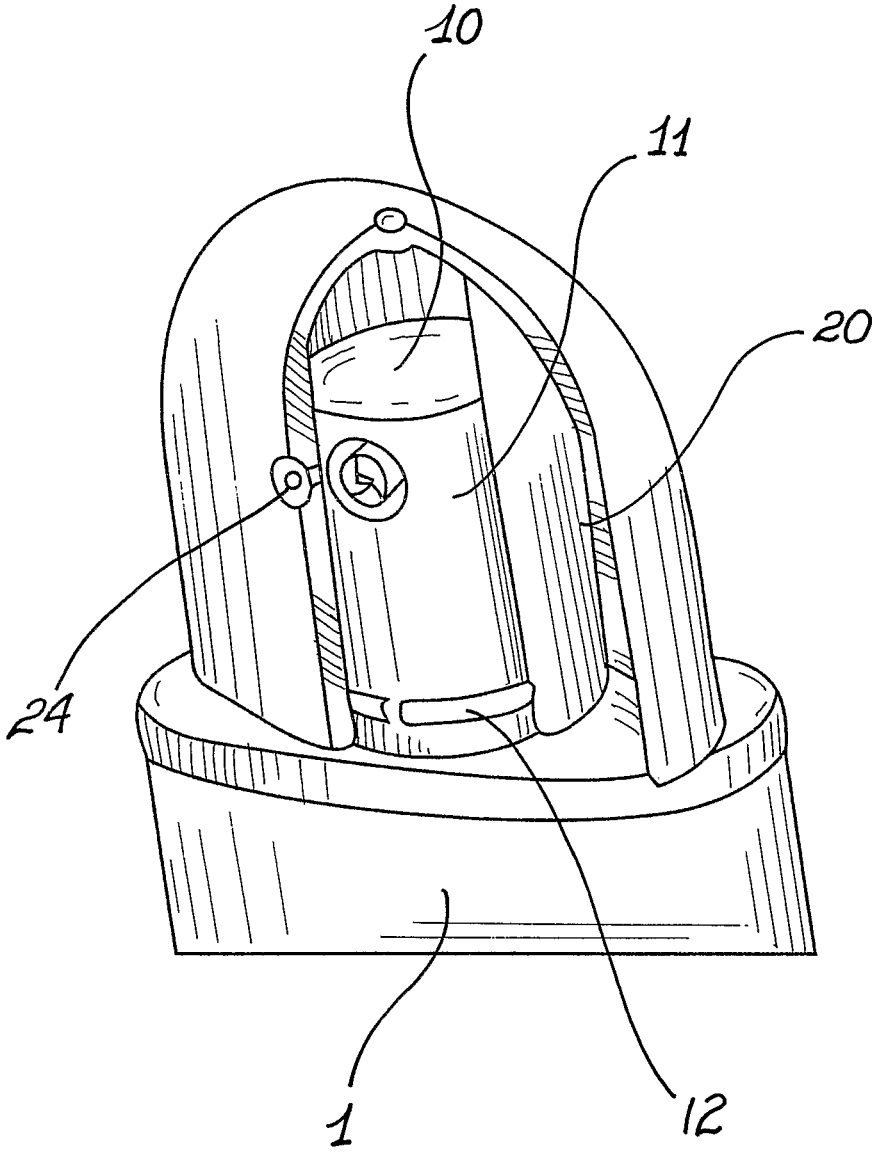
FIG. 2 is a partial, sectioned perspective view of the bottle of FIG. 1 in an assembled condition.
Figure 4:
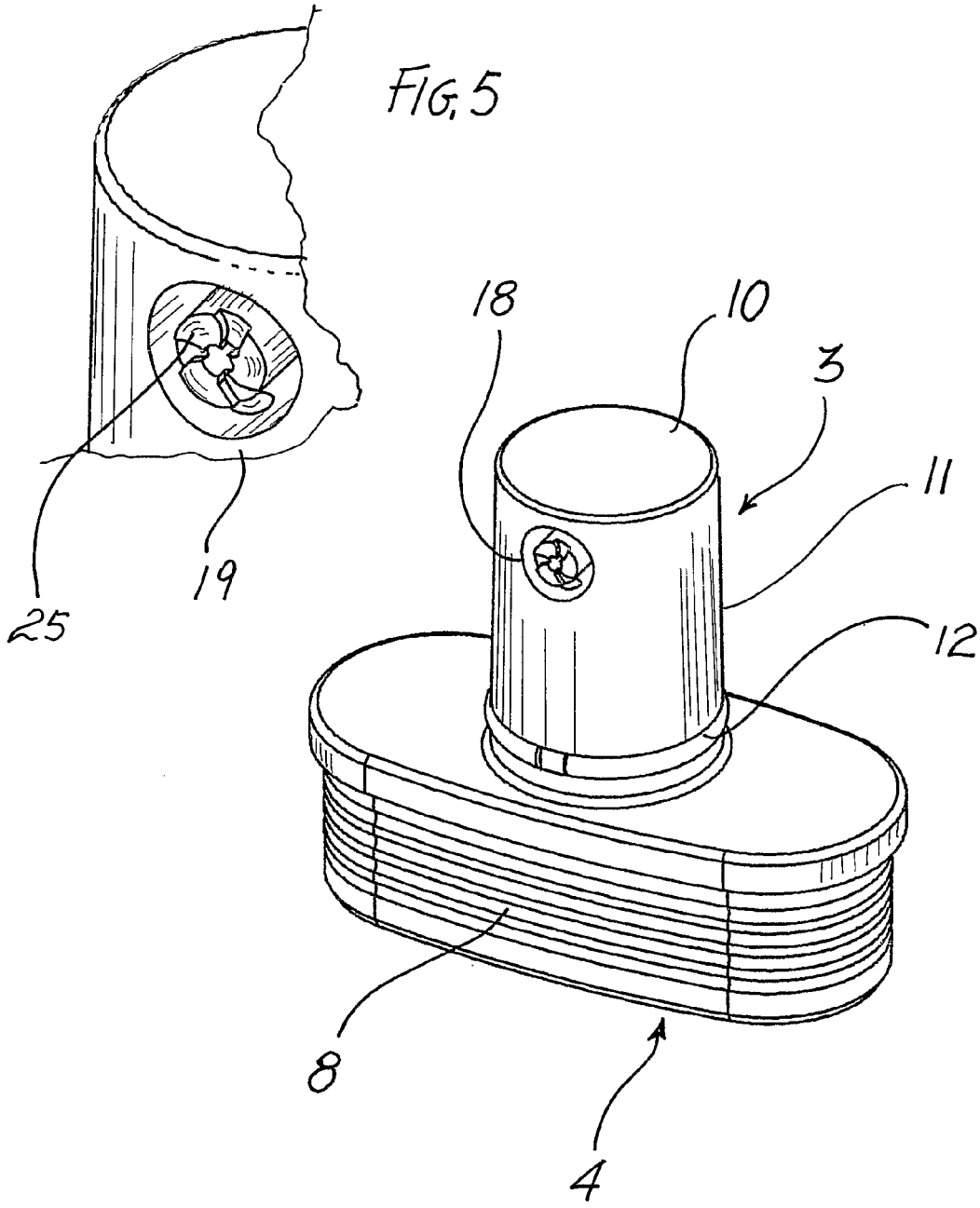
FIG. 4 is a perspective view of the nebuliser of the previous figures.

On the lateral surface 11 is formed a circumferential projection 12 shown in greater detail in FIGS. 2 and 4. FIG. 2 is a partial perspective view of the bottle, double cut in the closing cap to show the head 3 of the nebuliser 2 and the shape of the closing cap, internally provided with a tubular lid 20, whilst FIG. 4 globally show a perspective view of the nebuliser 2.

Figure 3:
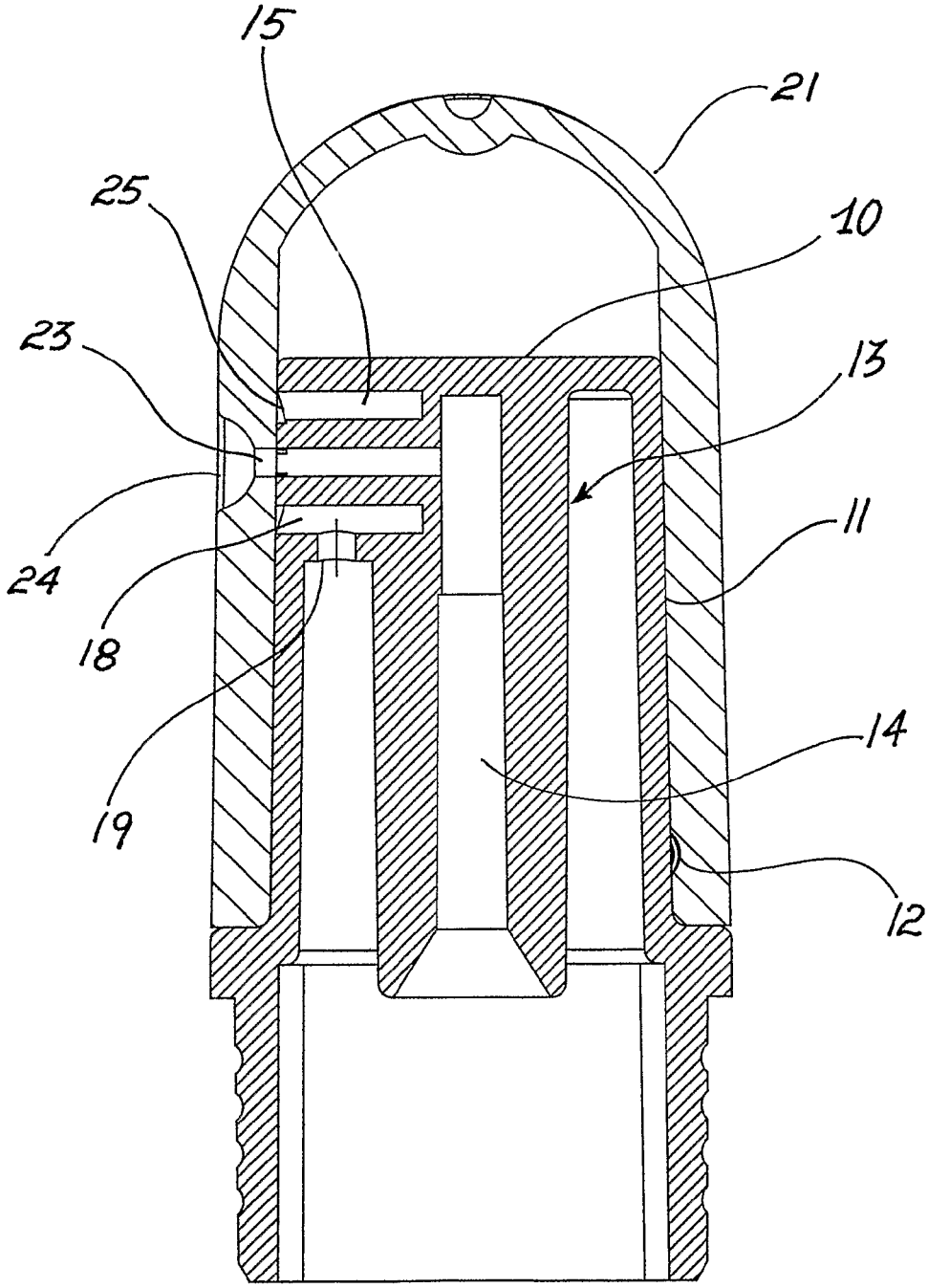
FIG. 3 is an axial section of the bottle of FIG. 2.

The interior of the head 3 is shown in longitudinal section in FIG. 3. Inside the head is obtained an elbow conduit 13 for the liquid to be sprayed.

The elbow conduit 13 extends, according to the longitudinal axis of the head 3, with a longitudinal segment 14 and with a transverse segment 15. In the longitudinal segment 14, which constructively is a tubular element joined to the summit 10 of the head 3, is engaged a suction tube 16, also shown in FIG. 1, which, with its end opposite from the engagement end, reaches the bottom of the bottle.

The transverse segment 15 preferably branches radially from the longitudinal segment 14 of the elbow conduit 13 of the liquid. To the transverse segment 15 is coaxial an air conduit 18.

The air conduit 18 transversely communicates, by means of a hole 19, with the interior of the head 3 of the nebuliser 2, and hence with the interior of the bottle 1. Anteriorly, the air conduit 18 extends substantially for the same length as the transverse segment 14 of the liquid, so that one and the other are delimited by the lid 20, which has substantially tubular shape, of the closing cap 5. The lid 20 is integrated in a dome 21 whose shape is preferably ellipsoidal in order to aesthetically conform by continuity of lines with the bottle 1, which is also ellipsoidal.

The tubular lid 20 is in fact slightly tapered upwards to slide, in substantially fluid-tight fashion, on the lateral surface 11 of the head 3 of the nebuliser 2.

The tubular lid 20 has a throat 22 (FIG. 1) destined to receive the circumferential projection 12 of the head 3. In this way the tubular lid 20, in a single piece with the dome 21, is constrained to rotate on the head 3. The ellipsoidal shape of the dome 21 facilitates gripping and rotating the closing cap 5. The closing cap 5 has on the tubular lid 20 an opening that serves as a discharge orifice with a cylindrical segment 23 and a hemispherical diffuser segment 24, when it faces the transverse conduit 15 of the liquid. In this position, the cap 5 is in an open position and the ellipsoidal surface of the cap is substantially in continuation of the lateral surface of the bottle 1.

The transverse segment of the conduit for the liquid has a plurality of radial channels 25. Said radial channels 25, whereof this embodiment has 3, are obtained at its free end of the transverse segment 15 and put in communication the conduit for the liquid 14 with the conduit for the air 18 before exiting through the discharge orifice 23-24.

When the cap is rotated even by a few degrees with respect to the open condition, the bottle is closed. However, it is readily apparent that its normal closed position is the one rotated by 180° relative to the open condition.

Preferably, the radial channels have a curved profile as shown in the detail of FIG. 5, to generate a swirling motion in the liquid to be nebulised at the time of its mixing with air.

In use, the elastically deformable bottle 1 contains in its interior a two-phase mixture constituted by the product to be dispensed and by the air that is mixed thereto in order to obtain nebulisation when compressing the bottle. The elasticity is such as to assure the correct replenishment of air inside the system in the subsequent release. Once it is filled with the product to be dispensed, the bottle is closed by inserting the body 4 of the nebuliser 2 into the bottle 1. The projections 8 of the body 4 together with the grooves 7 obtained in the bottle 1 form an undercut restraint system, thereby assuring that the product will be contained and sealed within the bottle.

The elbow conduit 13 for the liquid and the coaxial conduit 18 for the air, including the opening 19 with the rest of the bottle and the radial channels 25 for connecting the conduit of the liquid 13 and the conduit for the air 18, are selected in suitable dimensions to allow the outflow and the mixing of air and liquid in such proportions and modes as to assure an optimal nebulisation both in terms of particle size and spray angle. The suction tube 16, immersed in the liquid product to be dispensed, constitutes the first segment of the channel through which, by effect of internal pressure, the fluid reaches the nozzle. Then through the longitudinal segment 14 and the transverse segment 15, the liquid reaches the area of mixing with the air. The air conduit 18 is coaxial to that of the liquid and it communicates with the interior of the bottle 1 through the hole 19 obtained in the lower part of the coaxial air conduit 18 the three radial channels 25, appropriately contoured, through which the air converges on the conduit for the liquid to be mixed therewith, assure a dynamic action of the air on the liquid jet, creating turbulent motions which favour nebulisation even with relatively small air flow rates.

On the summit of the head 2 is anchored the closing cap 5, which in addition to symmetrically enhancing the overall aesthetics, allows to obtain the integral system of opening and closing of the package.

The closing cap 5, advantageously not removable in use, is fastened to the head 3 thanks to the circumferential projection 12 which allows its rotation for an angle of 180°, between the two extreme positions of opening and closing, in which the discharge orifice 23-24 is respectively aligned with the conduit for the liquid 15 or in opposition thereto. In the open position the discharge orifice 23-24, coupling with the terminal segment of the conduits 18 and 15 for the air and the liquid, the closing cap 5 defines and completes the mixing chamber, whilst in the closed position it determines the sealing of the conduits. The flows of air and liquid that simultaneously take place when the bottle is compressed, then converge into the mixing chamber and are ejected therefrom in the form of a spray. The aforesaid opening and closing positions are easily recognisable by the user, given the perfect aesthetic symmetry of the bottle according to the invention.

The operation of the aforesaid nebuliser is efficient. However, there may be the drawback of liquid leakage in the connecting region between the bottle and the nebuliser, since this region is deformed together with the bottle, when the bottle is squeezed.

To overcome this drawback, in a second embodiment of the invention, a hermetic seal is created between the bottle and the body of the nebuliser, in such a way as to prevent the liquid from leaking out of the bottle.

Figure 6:
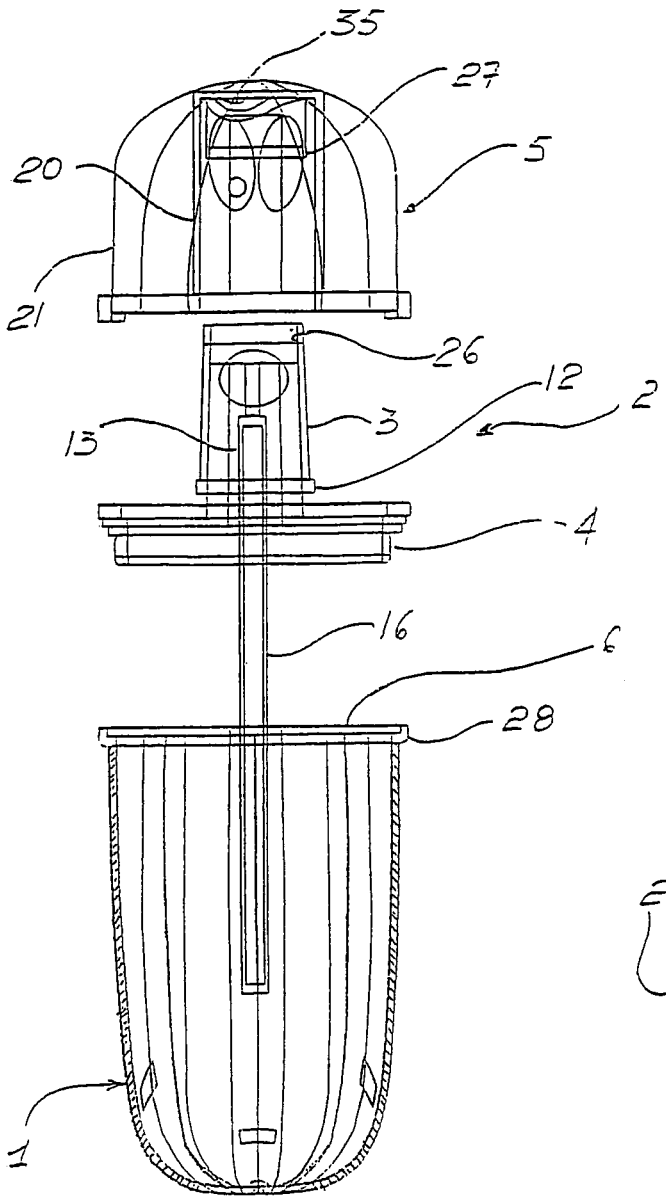
FIG. 6 is a perspective exploded, transparent, of an elastically deformable bottle provided with a nebuliser and with a closing cap according to a second embodiment of the present invention.

For this purpose, reference is made to FIG. 6, which is a perspective exploded, view, transparent to highlight the internal parts, of an elastically deformable bottle provided with a nebuliser and with a closing cap according to the second embodiment of the present invention. In FIG. 6, and in the following ones, which illustrate the second embodiment, identical or similar parts are designated with the same reference numbers as in the first embodiment.

The reference number 1 globally designates an elastically deformable bottle, 2 designates a nebuliser, constituted by a head 3 and a body 4, and 5 is a rotatable closing cap.

Figure 7:
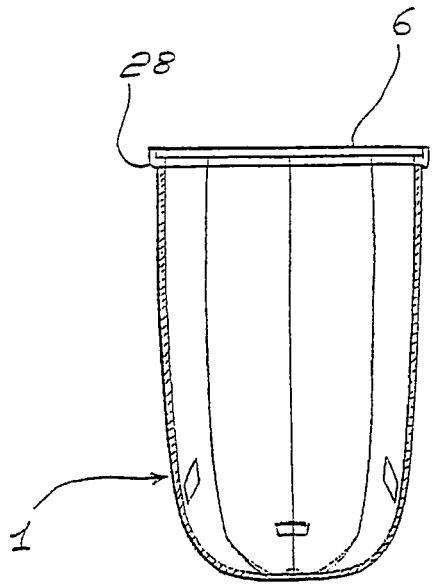
FIG. 7 is an enlarged longitudinal section of the bottle of FIG. 6.

As better shown in FIG. 7, which is a longitudinal view of the bottle 1, it has substantially ellipsoidal shape, cut transversely to the longitudinal axis to terminate in an elliptic end 6. At the cut end is provided an outwardly projecting edge 28. Said projecting edge 28 engages with a recessed peripheral portion 29 (FIG. 8) of the body 4 of the nebuliser that is received therein. The projecting edge 28 is hermetically sealed with the recessed peripheral portion 29, preferably by ultrasonic welding or by laser welding or by gluing or other technique, thereby obtaining fixed connecting means between the bottle and the nebuliser.

For coupling with the elliptical end opening 6, the body 4 of the nebuliser 2 also obviously has an ellipsoidal outer profile. The body 4 ends with a peripheral projection 30 protruding from the recessed portion 29. The peripheral projection 30 serves as an abutment for the body 4 of the nebuliser 2 on the elliptical end 6 of the bottle 1.

Figure 8:
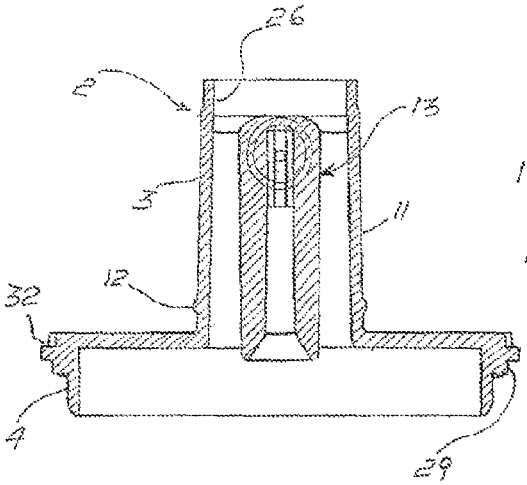
FIGS. 8 and 9 are axial sections having as a trace the main axis of the nebuliser of FIG. 6.
Figure 9:
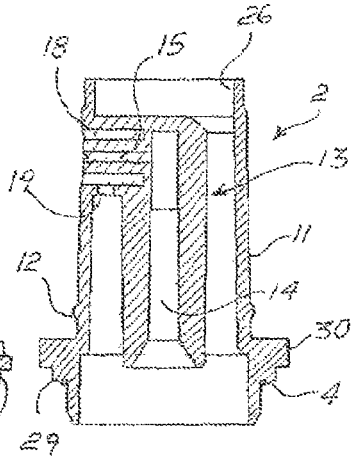

The head 3 of the nebuliser 2, in a single piece with the body 4, is substantially identical to that of the first embodiment and hence is not further described, but simply illustrated in the orthogonal sections of FIG. 8 and 9, which represent the interior of the head 3.

Figure 10:
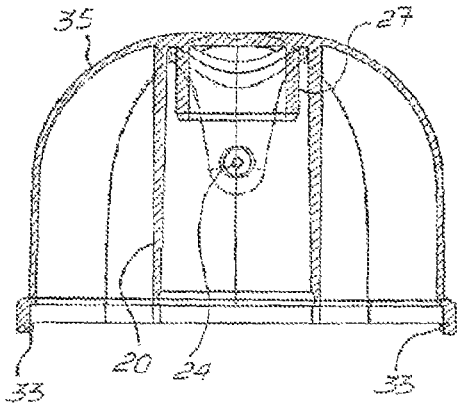
FIGS. 10 and 11 are axial sections according to the main axes of the closing cap of FIG. 6.
Figure 11:
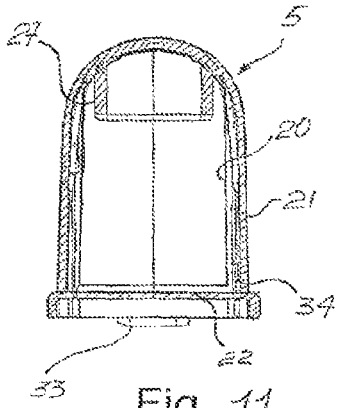

The tubular lid 20 of the cap 5 internally has a throat 22 destined to receive the circumferential projection 12 of the head 3. In this way the tubular lid 20, in a single piece with the dome 21, is constrained to rotate on the head 3. Between the tubular lid 20 and the dome 21 is a lightening 34, represented in particular in FIG. 11, which together with FIG. 10, shows an axial section of the cap.

The closing cap 5 has, both on the tubular lid 20 and on the dome 21, axial holes that serve as a discharge orifice, when said holes 24 face the transverse conduit 15 of the liquid. In this position, the cap 5 is in an open position and the ellipsoidal surface of the cap is substantially in continuation of the lateral surface of the bottle 1. To facilitate the recognition of the position of the coaxial holes 24, on the exterior of the cap is provided a depression 35.

When the cap is rotated even by a few degrees with respect to the open condition, the bottle is closed. However, it is readily apparent that its normal closed position is the one rotated by 180° relative to the open condition. This position is indicated by appendages 33 provided, mutually opposite, in the cap 5, and to be engaged in upper recesses 32 of the nebuliser body 4.

To prevent the liquid within the bottle 1 from leaking upwards through the opening 26 of the nebuliser 2, the cap 5 has in its interior a downwardly projecting edge 27, able hermetically to close the opening 26, when the cap 5 is applied to the head 3 of the nebuliser.

Since the nebuliser 2 is hermetically secured to the bottle 1, said bottle is filled before applying the cap 5 and introducing the liquid to be nebulised through the opening 26 of the nebuliser 2. Then, the cap 5 is applied, so that the tubular lid 20 is over the head 3 of the nebuliser 2. The engagement of the lid 5 with the nebuliser is obtained inserting the throat 22 of the tubular lid 20 over the circumferential projection 12 obtained on the lateral surface 11 of the head 3.

The closing lid 5 remains on the summit of the head 2 and it allows to obtain the integral system of opening and closing of the package.

In the nebulisation operation, or even when simply moving the bottle, the liquid within the bottle may even arrive into the cap 5, but it remains confined between the head 3 of the nebuliser 2 and the projecting edge 27 obtained within the tubular lid 20, so that there will be no loss towards the exterior.

The invention claimed is:

1. A nebulizing device, comprising:

an elastically deformable bottle having i) a suction tube immersed in a liquid to be nebulized and ii) an open end;

a nebulizer comprising i) a body and ii) a head, the body and head being made of a single piece, said body being connectable to the open end of the bottle, said head presenting an air conduit for air contained in the bottle; and a rotatable closing cap presenting a discharge orifice, wherein, said head has an elbow conduit for the liquid to be nebulized, said elbow conduit having i) a longitudinal segment for engaging the suction tube of the bottle and ii) a transverse segment for meeting the discharge orifice of the rotatable closing cap when said rotatable closing cap is in a nebulization position, said transverse segment of the elbow conduit is inserted coaxially with, and interior to, said air conduit, and said transverse segment has a terminal end comprising a plurality of radial channels for communicating with the air conduit, wherein the closing cap can be rotated between an open position and a closed position, in the open position the discharge orifice is aligned with the transverse segment of the elbow conduit allowing discharge of the liquid and in the closed position the discharge orifice is not aligned with the transverse segment of the elbow conduit sealing the transverse segment of the elbow conduit.

2. A nebulizing device as claimed in claim 1, wherein, said rotatable closing cap has the shape of a dome and comprises a tubular lid, and said head is externally provided with at least one peripheral projection for engaging with a corresponding internal throat of the tubular lid of the rotatable closing cap.

3. A nebulizing device as claimed in claim 2, wherein, said discharge orifice runs, in through fashion, inside the closing cap and the tubular lid, and said discharge orifice has an inner cylindrical segment and an external hemispherical diffuser segment, coaxial to one another.

4. A nebulizing device as claimed in claim 3, further comprising:

a detachable connection means, said body connectable to the bottle by said detachable connection means.

5. A nebulizing device as claimed in claim 3, further comprising: a fixed connection means, said body hermetically connectable to said bottle by said fixed connection means, and on opening along a perimeter of said head, said opening for communicating with the interior of the bottle, said opening being hermetically closable by a downwardly projecting edge of said rotatable closing cap.

6. A nebulizing device as claimed in claim 2, wherein, said body is connectable to the bottle by detachable connection means.

7. A nebulizing device as claimed in claim 2, wherein, said body is hermetically connectable to said bottle by fixed connection means, and said head, along a perimeter, has an opening for communicating with the interior of the bottle; said opening being hermetically closable by a downwardly projecting edge of said rotatable closing cap.

8. A nebulizing device as claimed in claim 1, wherein said radial channels have a curved profile effective to generate a swirling motion in the liquid to be nebulized at a time of the liquid mixing with air.

9. A nebulizing device as claimed in claim 1, wherein said body is connectable to the bottle by detachable connection means.

10. A nebulizing device as claimed in claim 9, wherein said detachable connecting means comprise a plurality of external peripheral projections extending from the body for fitting in a plurality of corresponding grooves presented by the bottle.

11. A nebulizing device as claimed in claim 1, wherein said body is hermetically connectable to said bottle by fixed connection means, and said head, along a perimeter, has an opening for communicating with the interior of the bottle, said opening being hermetically closable by a downwardly projecting edge of said rotatable closing cap.

12. A nebulizing device as claimed in claim 11, wherein, said fixed connecting means comprise a recessed peripheral portion provided in said body, and said recessed peripheral portion is connectable with a projecting edge outwardly extending from the open end of the bottle.

13. A nebulizing device as claimed in claim 1, wherein said body is, along a perimeter, provided with a peripheral projection surroundable by a projecting edge provided inferiorly in said rotatable closing cap.

14. A nebulizing device as claimed in claim 13, wherein said peripheral projection has at least one recess receiving an appendage of said rotatable closing cap.

15. The nebulizing device of claim 1, wherein the closing cap can be rotated for an angle of 180° between two extreme positions of opening and closing, in which the discharge orifice, in the closing position, is in opposition to the transverse segment of the elbow conduit for the liquid for sealing the transverse segment of the elbow conduit for the liquid.

* * * * *

UNITED STATES PATENT AND TRADEMARK OFFICE

CERTIFICATE OF CORRECTION

PATENT NO. : 8,469,290 B2
APPLICATION NO. : 11/628367
DATED : June 25, 2013
INVENTOR(S) : Angel Ciriani It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1247 days.

Signed and Sealed this
Eighth Day of September, 2015

Michelle K. Lee

Michelle K. Lee
*Director of the United States Patent and Trademark Office*